US005811384A

United States Patent [19]

Tracy et al.

[11] Patent Number: 5,811,384

[45] Date of Patent: Sep. 22, 1998

[54] NONIONIC GEMINI SURFACTANTS

[75] Inventors: David James Tracy; Ruoxin Li, both of Plainsboro; Manilal S. Dahanayake, Princeton Junction; Jiang Yang, Hightstown, all of N.J.

[73] Assignee: Rhodia Inc., Cranbury, N.J.

[21] Appl. No.: 979,052

[22] Filed: Nov. 26, 1997

[51] Int. Cl.[6] ..... C11D 1/72; C11D 1/722; C11D 1/755

[52] U.S. Cl. ..... 510/424; 510/421; 510/423; 510/433; 510/479; 510/480; 510/492; 510/497; 510/498; 510/499; 510/500; 510/501; 510/506; 554/101; 554/102; 554/116; 544/399

[58] Field of Search ..... 510/421, 423, 510/424, 433, 479, 480, 492, 497, 498, 499, 500, 501, 506; 554/107, 109, 227, 101, 102, 116; 544/399

[56] References Cited

U.S. PATENT DOCUMENTS

| | | | |
|---|---|---|---|
| 3,459,787 | 8/1969 | Weesner | 260/470 |
| 3,459,789 | 8/1969 | Mueller et al. | 260/482 |
| 3,513,133 | 5/1970 | Weesner | 260/75 |
| 4,892,806 | 1/1990 | Briggs et al. | 430/449 |
| 5,160,450 | 11/1992 | Okahara et al. | 252/174 |
| 5,403,922 | 4/1995 | Garelli-Calvet et al. | 536/1.11 |
| 5,488,180 | 1/1996 | Jenkins et al. | 568/609 |
| 5,512,699 | 4/1996 | Connor et al. | 564/153 |
| 5,534,197 | 7/1996 | Scheibel et al. | 510/356 |
| 5,585,516 | 12/1996 | Varadaraj et al. | 562/42 |
| 5,622,938 | 4/1997 | Wong | 514/35 |
| 5,643,864 | 7/1997 | Li et al. | 510/499 |

FOREIGN PATENT DOCUMENTS

| | | |
|---|---|---|
| 208562 | 7/1984 | Czechoslovakia . |
| 688781 | 12/1995 | European Pat. Off. . |
| 43 21 022 A1 | 6/1993 | Germany . |
| WO95/19951 | 7/1995 | WIPO . |
| WO95/19955 | 7/1995 | WIPO . |

OTHER PUBLICATIONS

Whalley, G.; HAPPI 98–102 (Apr. 1997).
Eastoe et al.; Langmuir 12; 2701–2705 (1996).
Seguer et al.; JAOCS 73; 1, 79–85 (1996).
Zhang et al.; J. Colloid Interface Sci 177, 419–426 (1996).
Allouch et al; JAOCS 73; 1 (87–96) (1996).
Briggs et al.; J. Chem. Soc. 46, 379–380 (1995).
Andre–Barres et al.; New J. Chem. 19; 345–347 (1995).
Eastoe et al.; Langmuir 10, 4429–4433 (1994).
Menger et al. J. Am. Chem. Soc. 115, 10083–10090(1993).
Rosen; Chemtech Mar. 1993 pp. 30–33.
Seguer et al; J. Disp. Sci and Tech. (591–610) (Jun. 24, 1993).
Zhu et al.; JAOCS 69 No. 7, 626–632 (Jul. 1992).
Zhu et al.; JAOCS 68 No. 7, 539–543 (Jul. 1991).
Zhu et al.; JAOCS 68 No. 4, 268–271 (Apr. 1991).
Latge et al.; J. Disp. Sci and Tech 12 (3&4) 227–237 (1991).
Zhu et al.; JAOCS 67 No. 7, 459–463 (Jul. 1990).
Micich; Jaocs 65, 5 820–825 (May 1988).
Hjelmeland et al.; Anal.Biochem 130; 485–490 (1983).
Emmerling et al.; Starch 33, 202–208 (1981).

*Primary Examiner*—Ardith Hertzog
*Assistant Examiner*—John R. Hardee
*Attorney, Agent, or Firm*—Craig M. Bell

[57] ABSTRACT

Novel nonionic gemini surfactants are extremely effective emulsifiers for oil-in-water emulsions that provide improved detergency at even low concentration levels. The surfactants are characterized by the formula:

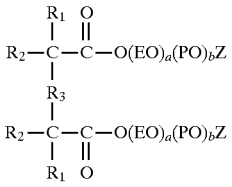

wherein $R_1$ is independently H or a $C_1$ to $C_{22}$ alkyl, $R_2$ is H or $C_1$ to $C_{22}$ alkyl and $R_3$ is $D_1$—$R_4$—$D_1$ or $R_4$—$D_1$—$R_4$ wherein $R_4$ is independently a $C_1$–$C_{10}$ alkyl group, —C(O)—, —$R_5$[O(EO)$_a$(PO)$_b$]—, —O—$R_5$—O—, or aryl, e.g. phenyl, and $D_1$ is independently —O—, —S—, —S—S—, —$SO_2$—, —C(O)—, a polyether group [—O(EO)$_a$(PO)$_b$—], an amide group [—C(O)N($R_6$)—], an amino group [—N($R_6$)—], —O—$R_5$—O—, or aryl. (EO)$_a$ (PO)$_b$ is a polyether group and Z is a $C_1$–$C_4$ alkyl, or an alkylaryl or hydrogen wherein EO represents ethyleneoxy radicals, PO represents propyleneoxy radicals, a and b are numbers of from 0 to 100, a is preferably from about 0 to about 30 and b is preferably from about 0 to 10, and wherein a plus b is at least one.

36 Claims, No Drawings

NONIONIC GEMINI SURFACTANTS

This invention relates to improved surfactants useful as emulsifiers and in detergents and personal care products at very low concentrations.

Emulsification is an extremely important technology and it is a process which is used in detergency, emulsion polymerization, cosmetics, food, agrochemicals, paints, paper, transportation of crude oil, etc. Emulsifiers function as essential ingredients in personal care and household products; industrial and institutional cleaners including shampoo, car washes, carpet shampoo, hand dishwashing liquids, latex foaming and oil recovery compositions; and the like.

In order to form a relatively stable emulsion, an emulsifier is required to adsorb at an oil-water interface to prevent emulsion droplet coalescence. The majority of emulsifiers are synthetic surfactants or natural products with amphiphilic character. Presently, usage levels of surfactants for effective emulsification are usually above 0.1% active based on the total weight of the detergent solution which is used in the final use composition. For a given emulsifier system, it would be advantageous to use a lower amount of surfactant to reduce the cost and amount of surfactant waste discharged into the environment; and to improve the performance of final products (e.g., the film forming and water resistance will be improved in latex paints and skin irritation will be reduced for cosmetic products).

While conventional surfactants generally have one hydrophilic group and one hydrophobic group, recently a class of compounds having at least two hydrophobic groups and at least two hydrophilic groups have been introduced. These have become known as "gemini surfactants" in the literature (*Chemtech,* March 1993, pp 30–33, and *J. Am. Chem. Soc.,* 115, 10083–10090, (1993) and the references cited therein). Other gemini surfactant compounds, that is, compounds having at least two hydrophilic groups and at least two hydrophobic groups are also disclosed in literature but often are not referred to expressly as gemini surfactants.

An intensive study of gemini surfactants as emulsifiers has been made. From these studies, it has been found that gemini surfactants are unexpectedly effective emulsifiers when used at very low concentrations in comparison to conventional surfactants. This finding is reflected in superior detergency at very low concentrations. Other performance properties related to emulsification as mentioned above can also be improved using low concentrations of gemini surfactants.

SUMMARY OF THE INVENTION

In accordance with the present invention, it has been discovered that gemini surfactants of the type described and claimed herein can be extremely effective emulsifiers for oil-in-water emulsions at lower concentrations than that needed utilizing corresponding conventional surfactants. Furthermore, the detergency is also improved over that provided by conventional surfactants at these low concentration levels.

These novel gemini surfactants are also able to lower the monomer concentration of anionic surfactants when the two are mixed in a blend. This results in less skin irritation and the other toxic side effects of anionics.

DETAILED DESCRIPTION OF THE INVENTION

The novel surfactant compounds of the invention are based on certain gemini surfactants. As used herein, the term "gemini surfactants" is intended to mean surfactants having at least 2 hydrophobic groups and at least 2 hydrophilic groups per molecule.

A number of the gemini surfactants are reported in the literature, see for example, Okahara et al., J. Japan Oil Chem. Soc. 746 (Yukagaku) (1989); Zhu et al., 67 JAOCS 7,459 (July 1990); Zhu et al., 68 JAOCS 7,539 (1991); Menger et al., J. Am. Chemical Soc. 113, 1451 (1991); Masuyama et al., 41 J. Japan Chem. Soc. 4,301 (1992); Zhu et al., 69 JAOCS 1,30 (Jan. 1992); Zhu et al., 69 JAOCS 7,626 July 1992); Menger et al., 115 J. Am. Chem. Soc. 2, 10083 (1993); Rosen, Chemtech 30 (March 1993); and Gao et al., 71 JAOCS 7,771 (July 1994), all of this literature being incorporated herein by reference.

Also, gemini surfactants are disclosed by U.S. Pat. No. 2,374,354 to Kaplan; Nos.2,524,218 and 2,530,147 to Bersworth (two hydrophobic tails and three hydrophilic heads); No. 3,244,724 to Guttmann; and No. 5,160,450, to Okahara, et al., all of which are incorporated herein by reference.

The gemini surfactants may be anionic, nonionic, cationic or amphoteric. The hydrophilic and hydrophobic groups of each surfactant moiety may be any of those known to be used in conventional surfactants having one hydrophilic group and one hydrophobic group. For example, a typical nonionic gemini surfactant, e.g., a bis-polyoxyethylene alkyl ether, would contain two polyoxyethylene alkyl ether moieties. However, non-ionic gemini surfactants prior to this are extremely rare.

Gemini surfactants are relatively quite new and few species have been reported or disclosed in the prior art. U.S. Pat. No. 5,534,197 to Scheibel teaches a method for the preparation of a nonionic gemini surfactant wherein the hydrophilic head is a sugar or carbohydrate while the hydrophobic head is a long chain alkyl, the two being joined by a short alkyl chain. U.S. Pat. Nos. 3,888,797 and 3,855,156, both to Marumo, disclose a number of nonionic gemini surfactant species in which the hydrophobic portion is comprised of a long chain lower alkyl or alkene while the hydrophilic portion is comprised of an ethoxylate group. U.S. Pat. No. 4,892,806 to Briggs and European Patent No. 0,688,781A1 to Adams also disclose sugar-based hydrophilic heads joined to the hydrophobic counterpart by a short chain carbon bridge.

Each moiety would contain a hydrophilic group, e.g., polyoxyethylene, and a hydrophobic group, e.g., an alkyl chain.

Nonionic gemini surfactants which are useful in the present invention include those of the formula:

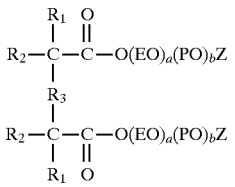

I.

wherein $R_1$ is independently H or a C, to $C_{22}$ alkyl, $R_2$ is H or $C_1$ to $C_{22}$ alkyl and $R_3$ is —C(O)—, S, $SO_2$, S—S or $D_1$—$R_4$—$D_1$ or $R_4$—$D_1$—$R_4$ wherein $R_4$ is independently a $C_1$–$C_{10}$ alkyl group, —C(O)—, —$R_5$[O(EO)$_a$(PO)$_b$]—, —O—$R_5$—O—, or aryl, e.g. phenyl, and D, is independently —O—, —S—, —S—S—, —$SO_2$—, —C(O)—, a polyether group [—O(EO)$_a$(PO)$_b$—], an amide group [—C(O)N($R_6$)—], an amino group [—N($R_6$)—], —O—$R_5$—O—, or aryl, (EO)$_a$(PO)$_b$ is a polyether group and Z is a $C_1$–$C_4$ alkyl, or an alkylaryl or hydrogen. When $D_1$ is an amino group, then $R_6$, $R_4$, and $D_1$ can be part of a heterocyclic ring. $R_5$ and $R_6$ are a $C_1$ to $C_{10}$ alkyl, aryl, or alkylaryl.

Wherein EO represents ethyleneoxy radicals, PO represents propyleneoxy radicals. The letters a and b represent numbers of from 0 to 100, a is preferably from about 0 to about 30 and b is preferably from about 0 to 10, wherein a plus b is at least one, and the EO and PO radicals can be randomly mixed or in discrete blocks.

With respect to the formulae of this disclosure, the term "alkyl" includes substituted alkyl, especially the hydroxy substituted derivatives thereof and also straight as well as branched chains. When Z is hydrogen, the gemini surfactants are nonionic and when Z is a $C_1$ to $C_4$ alkyl, or an alkylaryl, they become low foaming nonionics.

The compounds of Formula I are more fully described in copending application U.S. Ser. No. 08/292,907 now U.S. Pat. No. 5,643,864 filed Aug. 19, 1994, the entire disclosure of which is incorporated herein by reference.

Particular gemini surfactants specifically useful in the present invention include nonionic surfactants of the formula:

II.

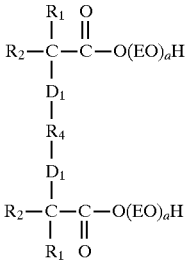

wherein $R_1$ represents H or is a $C_1$ to $C_{22}$ alkyl or aryl, $R_2$ is a $C_1$ to $C_{22}$ alkyl or aryl, a and $R_4$ have been hereinbefore defined and $D_1$ is O, S, or N—$R_6$ wherein $R_6$ is $C_1$–$C_{10}$ alkyl, aryl or alkylaryl.

Preferably, the nonionic gemini surfactants that are useful in the practice of the present invention are selected from the following structures:

III.

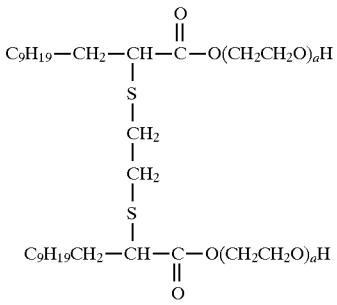

IV.

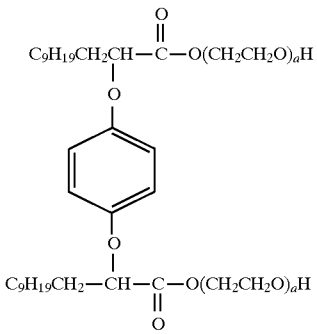

-continued

V.

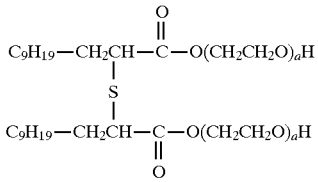

VI.

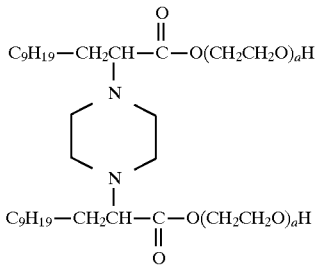

The gemini surfactants corresponding to the general formula II can be prepared using the following basic series of reactions:

I.

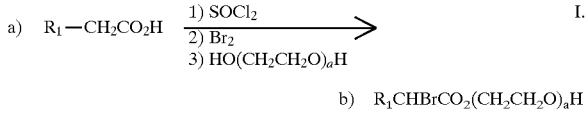

The synthesis of α-halo acids is well known in the art; see for example Org. Syn. Coll. III p. 523; 848 which is hereby incorporated by reference.

b)

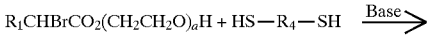

c)

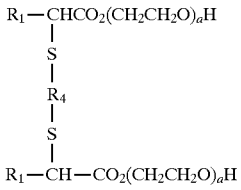

wherein $R_4$ is independently a $C_2$–$C_{22}$ alkyl, aryl or alkylaryl.

Ethanedithiol, propanedithiol, butanedithiol, hexanedithiol, xylenedithiol and benzenedithiol comprise typical bismercaptan species of the novel nonionic gemini surfactants of the present invention as set forth above.

II. A second reaction scheme for the preparation of diether-coupled gemini surfactants is as follows:

a)

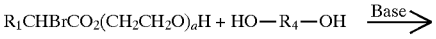

-continued b)

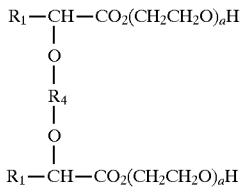

where $R_1$ is independently H or $C_1$–$C_{22}$ alkyl, aryl, or alkylaryl and a is a number of from 1–12. $R_4$ is independently any $C_1$–$C_{22}$ alkyl, aryl, or alkylaryl. Typical gemini nonionic-coupling diols include ethylene glycol, propylene glycol, butylene glycol, diethylene glycol, hexylene glycol, hydroquinone, xylenediol and the like.

III. Amine-coupled nonionic gemini surfactants are also useful according to the practice of the present invention and may be synthesized as follows:

a)

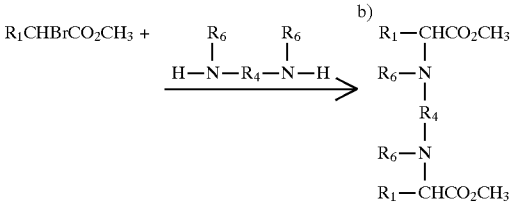

b)

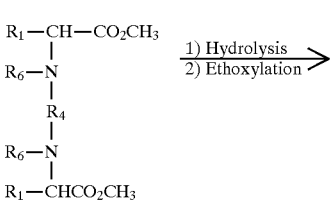

c)

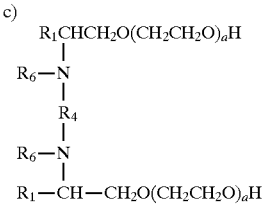

wherein $R_1$, $R_4$ and $R_6$ are hereinbefore defined and a is a number from 1 to 12. Typical amine nonionic gemini surfactants useful in the present invention comprise piperazine, methylamine; N,N$^1$ -dimethylethylenediamine, xylenediamine, N,N$^1$-dimethylbutanediamine, N,N$^1$- dimethylbutenediamine and N,N$^1$-dimethyl-1,6-hexanediamine and urea.

IV. Novel nonionic gemini surfactants may be prepared by the following reaction schemes:

a)

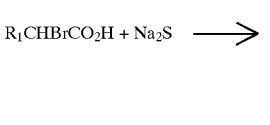

b)

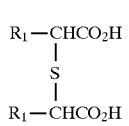

-continued b)

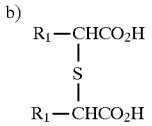

c)

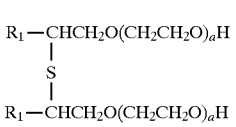

The compounds of Formula I and II are more fully described in copending application U.S. Ser. No. 08/009,075 filed Dec. 21, 1995, the entire disclosure of which is incorporated herein by reference.

The synthesis of α-halo acids is well known in the art; see for example Org. Syn. Coll. III p. 523: 848 which is hereby incorporated by reference.

b)

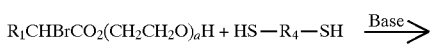

c)

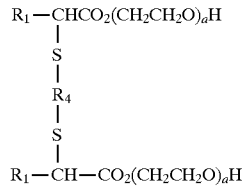

wherein $R_4$ is independently a $C_2$–$C_{22}$ alkyl, aryl or alkylaryl.

This class of gemini surfactants as disclosed in the present invention can be used in providing improved emulsions which are operable at lower concentrations than the known surfactants of the prior art.

In the compounds used in the invention, many of the moieties can be derived from natural sources which will generally contain mixtures of different saturated and unsaturated carbon chain lengths. The natural sources can be illustrated by coconut oil or similar natural oil sources such as palm kernel oil, palm oil, soya oil, rapeseed oil, castor oil or animal fat sources such as herring oil and beef tallow. Generally, the fatty acids from natural sources in the form of the fatty acid or the triglyceride oil can be a mixture of alkyl radicals containing from about 5 to about 22 carbon atoms. Illustrative of fatty acids are caprylic ($C_8$), capric ($C_{10}$), lauric ($C_{12}$), myristic ($C_{14}$), palmitic ($C_{16}$), stearic ($C_{18}$), oleic ($C_{18}$, monounsaturated), linoleic ($C_{18}$, diunsaturated), linolenic ($C_{18}$, triunsaturated), ricinoleic ($C_{18}$, monounsaturated) arachidic ($C_{20}$), gadolic ($C_{20}$, monounsaturated), behenic ($C_{22}$) and erucic ($C_{22}$). These fatty acids can be used per se, as concentrated cuts or as fractionations of natural source acids. The fatty acids with even numbered carbon chain lengths are given as illustrative though the odd numbered fatty acids can also be used. In addition, single carboxylic acids, e.g., lauric acid, or other cuts, as suited for the particular application, may be used as well as acids derived from Guerbet alcohols.

Where desired, the surfactants used in the present invention can be oxyalkylated by reacting the product with an alkylene oxide according to known methods, preferably in the presence of an alkaline catalyst.

For alkylation conditions and commonly used alkylating agents, see Amphoteric Surfactants Vol. 12, Ed. B. R. Bluestein and C. L. Hilton, *Surfactant Science Series* 1982, pg. 17 and references cited therein, the disclosures of which are incorporated herein by reference.

The surfactant compositions comprising the gemini nonionic compounds of the invention are extremely effective in aqueous solution at low concentrations as defined herein. The surfactants of the invention can be used in any amount needed for a particular application which can be easily determined by a skilled artisan without undue experimentation.

Another important unexpected property of the Gemini Surfactants is their ability to significantly lower the ionic monomer concentration in mixtures of anionic/nonionic or anionic/nonionic/amphoteric or anionic/nonionic/cationic surfactant mixtures. It is well know that anionic monomers that are useful in personal care systems are responsible for higher toxicity and skin irritancy. Further, anionic surfactant monomers are responsible for the deactivation of enzymes used in detergent systems and moreover, being anionic, they interact strongly with proteins and enzymes thereby deactivating them. Also anionic surfactants very often absorb onto polymers used in detergents, wastewater treatment systems and conditioning agents used in personal care applications and so on, thereby changing the charged nature of such polymers. This results in the complete loss or poor performance for the polymers in their application.

The use of gemini surfactants in very small amounts in the presence of an anionic surfactant such as lauryl ether sulfate (ESY) dramatically reduces the anionic monomers. With the addition of less than a 0.1 mole fraction of the gemini surfactant, the anionic concentration in the mixture is brought down by greater than an order of magnitude of ten. This dramatic reduction of the anionic monomer at these very low concentrations will result in the elimination of any detrimental effects discussed above and brought about as a result of the anionic monomers. Therefore, this ability to decrease the anionic (or cationic) monomers in solution should provide performance enhancement for the surfactant or the surfactant polymer/enzyme mixtures and the other performance additives very often found in detergents, and personal care formulations.

Whereas the surfactants of the invention can be used alone as the essential hydrotrope component, it has been unexpectedly found that blends of the compounds of the invention with certain conventional well known anionic, nonionic, cationic and amphoteric surfactants, as well as polymers and enzymes to provide results beyond that expected and are therefore synergistic, a phenomenon that can be demonstrated in terms of critical micelle concentration and surface tension reducing ability and detergency.

Examples of the nonionic surfactants used herein include fatty acid glycerine esters, sorbitan fatty acid esters, sucrose fatty acid esters, polyglycerine fatty acid esters, higher alcohol ethylene oxide adducts, single long chain polyoxyethylene alkyl ethers, polyoxyethylene alkyl allyl ethers, polyoxyethylene lanolin alcohol, polyoxyethylene fatty acid esters, polyoxyethylene glycerine fatty acid esters, polyoxyethylene propylene glycol fatty acid esters, polyoxyethylene sorbitol fatty acid esters, polyoxyethylene castor oil or hardened castor oil derivatives, polyoxyethylene lanolin derivatives, polyoxyethylene fatty acid amides, polyoxyethylene alkyl amines, an alkylpyrrolidone, glucamides, alkylpolyglucosides, mono- and dialkanol amides, a polyoxyethylene alcohol mono- or diamides and alkylamine oxides. Examples of the anionic surfactants used herein include fatty acid soaps, ether carboxylic acids and salts thereof, alkane sulfonate salts, α-olefin sulfonate salts, sulfonate salts of higher fatty acid esters, higher alcohol sulfate ester salts, fatty alcohol ether sulfates salts, higher alcohol phosphate ester salts, fatty alcohol ether phosphate ester salts, condensates of higher fatty acids and amino acids, and collagen hydrolysate derivatives.

Examples of the cationic surfactants used herein include alkyltrimethylammonium salts, dialkyldimethylammonium salts, alkyldimethylbenzylammonium salts, alkylpyridinium salts, alkylisoquinolinium salts, benzethonium chloride, and acylamino acid type cationic surfactants. Examples of the amphoteric surfactants used herein include amino acid, betaine, sultaine, phosphobetaines, imidazoline type amphoteric surfactants, soybean phospholipid, and yolk lecithin.

Any of the commonly used auxiliary additives such as inorganic salts such as Glauber salt and common salt, builders, humectants, solubilizing agents, UV absorbers, softeners, chelating agents, and viscosity modifiers may be added to the surfactants of the invention or blends thereof with other surfactants as disclosed herein.

The nonionic surfactants of the invention are extremely mild and non-irritating to both eyes and skin. They also exhibit enhanced wetting speed, greater surface tension reduction, high foaming and foam stabilization properties, low toxicity, and excellent compatibility with other anionic, cationic, and nonionic surfactants. They show unique performance attributes i.e., superior solubilization of co-ingredients, stabilization of enzymes and the enhanced removal of stains. The products of the invention are stable over a wide pH range and are biodegradable. These properties make these surfactants adaptable for use in products ranging from cosmetics to industrial applications and are usable wherever anionic surfactants have found use. These products are particularly useful for non-irritating shampoos, including baby shampoos, body shampoos including bubble baths, bar soaps, bath gels, hair conditioning gels, lotions, skin creams and lotions, make up removal creams and lotions, liquid detergents, dish detergents, and other washing and cosmetic products that contact the skin. The surfactants of the invention can also find use as hard surface cleaners including cars, dishes, toilets, floors, and the like; laundry detergents and soaps, metal working aids and the like. They are also compatible with bleaching agents and are able to stabilize enzymes and enhance the removal of oily soils in detergent systems.

The following examples are provided to more fully disclose, describe and set forth the elements and embodiments of the surfactants of the present invention. They are for illustrative purposes only, and it is recognized that minor changes or alterations may be made to the reaction parameters, reactants and isolation procedures that are not disclosed herein. However, to the extent that any such changes do not materially alter the final product or result, such alternative measures are deemed as falling within the spirit and scope of the invention as recited by the claims that follow.

Example I—Preparation of Thioether Structure II (A) Preparation of Intermediate I

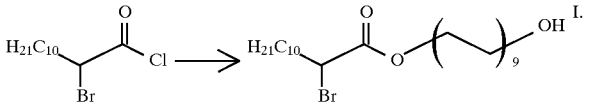

I.

Polyethylene glycol-400 (26 gm.) was dissolved in a dry ethyl acetate solvent at room temperature. A small amount of sodium carbonate was added to the solution as base. α-Bromolauric acid chloride (8.5 gm., 28.57 mmol) was added dropwise to the mixture at zero degrees. The reaction was gradually heated to 50° C. and stirred for 15 hours at such temperature. The reaction was then stopped by cooling to room temperature. The crude product was extracted twice with η-butanol. The organic layer was collected and dried under vacuum. NMR results agreed with the expected structure (I) of the final product. The yield of the reaction was about 80%.

(B) Coupling Reaction

II.

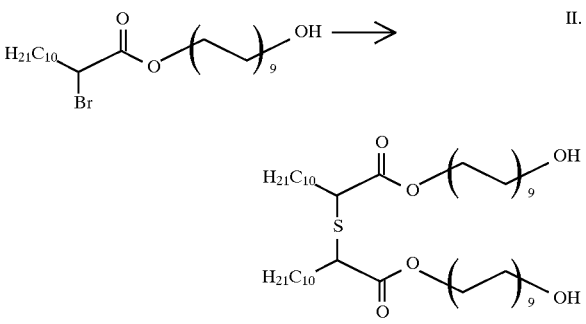

Intermediate I, α-bromolauric acid ester ethoxylated with 9 EO (15 gm., 22.1 mmol) was dissolved in a dry DMF at room temperature. A sodium sulfide solution dissolved in the minimum amount of dry methanol was added dropwise to the above reaction solution. The reaction was allowed to be stirred overnight at 65° C. and then cooled to 15° C. The crude product was extracted with a chloroform/methanol solvent system twice and then dried under reduced pressure. The final product was analyzed by NMR. The analytic results agreed with the structure of the final product. The final compound was about 90% purity with 85% yield.

Example II—Preparation of Bisthioether Structure III

III.

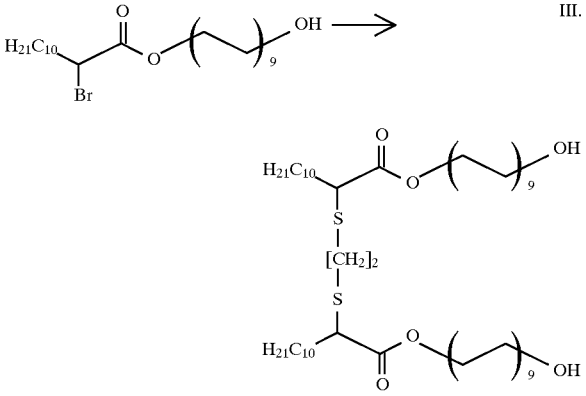

Intermediate I, α-bromolauric acid ester ethoxylated with 9 EO (10 gm., 14.73 mmol) and ethylenedithiol were dissolved in a dry DMF at room temperature. Excess sodium carbonate was added as a base. The reaction was stirred for 14 hours at 60° C. It was then stopped by pouring the solution into ice water. The crude product was extracted with a chloroform/methanol solvent system twice and then dried under vacuum. The structure of the final compound was confirmed by the NMR analysis. The yield of the reaction was about 80%.

Example III—Preparation of Bisthioether Structure IV (A) Preparation of Intermediate V

V.

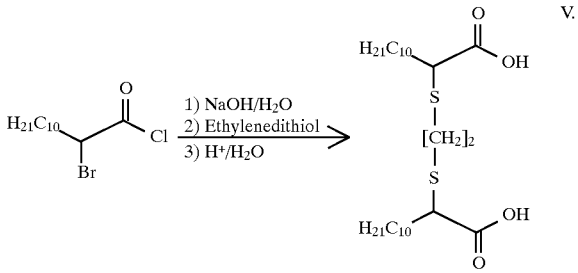

Intermediate V, α-Bromolauric acid chloride (110 gm., 0.37 mmol) was stirred with two equivalent weight sodium carbonate in a water solution at 70° C. for 3 hours. The temperature was then lowered to 30° C. and the ethylenedithiol (17 gm., 0.18 mmol) was added to the reaction mixture. After the reaction had been stirred for 15 hours at 70° C., the solution was cooled to room temperature and acidified to about pH 2. The crude product was extracted with η-butanol twice. Once the solvent was evaporated, the remaining solid material was collected and dried under vacuum. The NMR results confirmed the solid material formed was the expected product. The yield of the reaction was about 85%.

(B) Ethoxylation

IV.

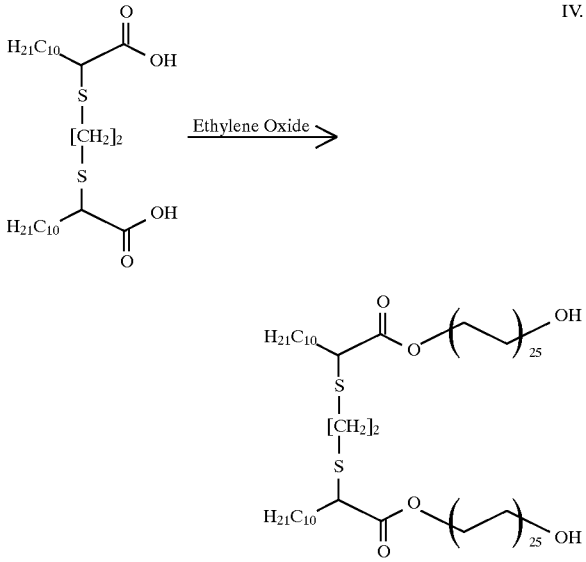

Intermediate IV, ethylenedithio-bis-lauric acid (254.1 gm., 0.519 mmol) was melted at 150° C. in a 2 gal. autoclave under nitrogen. Potassium hydroxide (4.43 gm., 45% water solution) was added to the autoclave. The mixture was stirred for 30 minutes at 140° C. under vacuum to remove trace water. Then, the air inside the autoclave was replaced with nitrogen. The autoclave was then heated to 160°–170° C. Ethylene oxide (2285 gm.) was then added slowly and the pressure of the ethylene oxide inside the reactor was maintained under 53 psig. After a few hours of constant pressure, all of the ethylene oxide was added and the autoclave was cooled to 120° C. A vacuum was applied for 20 minutes to strip any volatile compounds present. Finally, after cooling, the pH of the solution was adjusted to 7.0 by adding small amounts of acetic acid. The NMR results indicated 50 mols EO was reacted.

The nonionic surfactant compounds of the present invention are large molecules which are consequently characterized by low mobility and do not easily penetrate barriers such as synthetic and biological membranes. When formulated as personal care or household cleaning products, these surfactants produce solutions with extremely low surface tension values that exhibit superior surface active characteristics. Their low mobility, their inability to penetrate membranes to any large degree and excellent cleaning ability render them well adapted for shampoo formulations, facial soaps and other personal care products as they exhibit extremely low irritancy when in contact with the eyes and skin.

The surfactants of this invention afford superior foaming characteristics and enhanced surface tension reduction properties. This unusually high surface activity for these molecules is a result of their unique structure; the presence of two optimally spaced hydrophobic chains and hydrophilic groups.

When the surface properties for the nonionic gemini surfactant compounds of the invention were compared to the corresponding conventional nonionic surfactants, the novel compounds of the invention showed two unexpected surface active properties; unusually low critical micelle concentration (cmc) and low $pC_{20}$ values in aqueous media. These properties are a measure of the tendency of the surfactant to form micelles which adsorb at the interface, and consequently, reduce surface tension.

This unusually high surface activity for these molecules is a result of their unique structure; the presence of two optimally spaced hydrophobic chains and hydrophilic groups.

This molecular structure also provides energetically favorable decreases in the free energy of adsorption and micellization through the favorable distortion of water structure, and at the same time, providing a "close packed" arrangement at the interface. This is reflected by the relatively low surface area per molecule that is unexpected from the molecular dimensions for the molecule. The area per molecule for the compounds of the invention are comparable to corresponding conventional surfactants. The ability of the compounds of the invention to distort water structure through the inhibition of crystalline or liquid crystalline phase formation in bulk phase and at the same time their ability to pack closely on adsorption at the interface is contrary to conventional wisdom. This again demonstrates the uniqueness of the molecular design for these compounds which is very critical to providing the unexpected exceptional surface and performance properties.

The exceptional surface activity and unique structural features of the surfactants of the present invention provide two other important performance properties that can have immense practical application in industry. One is their hydrotropicity which is the ability of organic substances to increase the solubility of other insoluble organic substances in water. The other feature is their solubilization, the ability to dissolve water insoluble organic compounds into aqueous surfactant solutions above their cmc levels. The compounds of the invention, because of their very low cmc values, are efficient solubilizers. This latter property will not only allow the formulation of homogeneous water insoluble materials, but also will enhance the surface activity of other surfactants whose low water solubility restrict their use. These novel surfactants of the invention are far better than comparable conventional surfactants in hydrotroping and solubilizing properties.

Because of their unusually high surface activity, coupled with their hydrotropicity and solubilization properties, compounds of this invention will provide exceptionally high performance properties at very low concentrations in practical applications such as detergency emulsification, solubilization, dispersancy, hydrotropicity, foaming and wetting. In addition, due to their extremely low monomer concentration at standard use levels and because of their extremely low cmc values, the use of lower concentrations of the compounds of the invention than conventional surfactants can provide extremely low or no irritancy in personal care applications as well as being non-toxic, biodegradable and environmentally friendly.

What we claim is:

1. A composition of matter comprised of one or more of the surfactant compound of the formula:

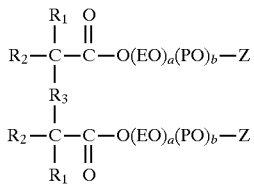

I.

wherein $R_1$ is independently H or a $C_1$ to $C_{22}$ alkyl, $R_2$ is H or C, to $C_{22}$ alkyl and $R_3$ is C(O), S, $SO_2$, S—S, $D_1$—$R_4$—$D_1$ or $R_4$—$D_1$—$R_4$ wherein $R_4$ is independently a $C_1$–$C_{10}$ alkylene group, —C(O)—, $R_5[O(EO)_a(PO)_b]$—, —O—$R_5$—O—, or arylene and $D_1$ is independently —O—, —S—, —S—S—, —$SO_2$—, —C(O)—, a polyether group [—$O(EO)_a(PO)_b$—], an amide group [—C(O)N($R_6$)—], an amino group [—O—N($R_6$)—], —O—$R_5$—O—, or aryl; $R_5$ and $R_6$ are $C_1$–$C_{10}$ alkyl, aryl, or alkylaryl and when $D_1$ is an amino group, then $R_6$, $R_4$ and $D_1$ can be part of a heterocyclic ring. $(EO)_a(PO)_b$ is a polyether group and Z is a $C_1$–$C_4$ alkyl, or an alkylaryl or hydrogen and a and b are whole integers of from 0 to 100 with the proviso that a plus b is at least 1.

2. The composition of claim 1 wherein the compound has the structure:

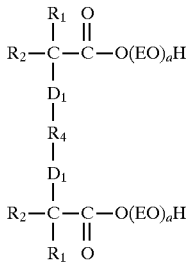

where $R_1$ is independently H or a $C_1$ to $C_{22}$ alkyl or aryl, $R_2$ is a $C_1$ to $C_{22}$ alkyl or aryl, $R_4$ is hereinbefore defined and $D_1$ is 0, S or N—$R_6$ wherein $R_6$ is a $C_1$–$C_{10}$ alkyl, or alkylaryl and when D is an amino group, then $R_6$, $R_4$ and $D_1$ can be a part of a heterocyclic ring and a is a number between 1 and 200.

3. The composition of claim 2 wherein the compound has the structure:

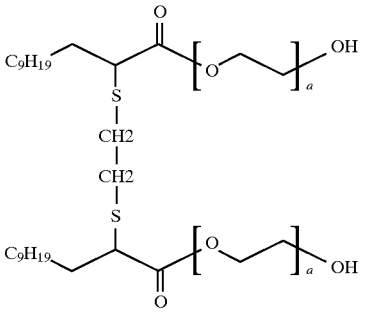

wherein a is a whole number of from about 4 to 25.

4. The surfactant composition of claim 2 wherein the compound has the structure:

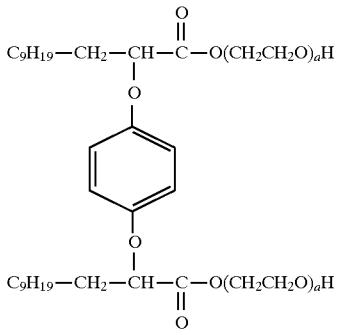

wherein a is a whole number of from 1 to about 22.

5. The surfactant composition of claim 1 wherein the compound has the structure:

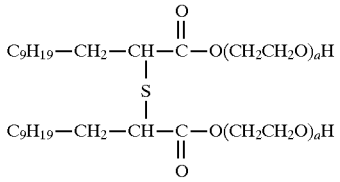

wherein a is a whole number of from 1 to about 22.

6. The surfactant composition of claim 2 wherein the compound has the structure:

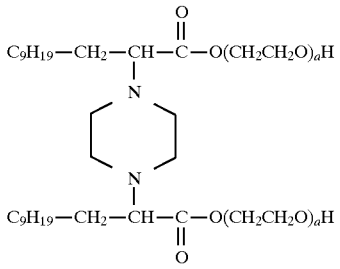

wherein a is a whole number of from 1 to about 22.

7. The composition of claim 1 wherein the compound has the structure:

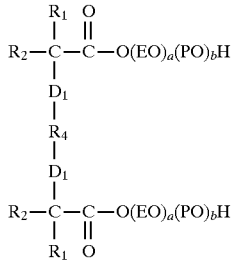

where $R_1$ is independently H or a $C_1$ to $C_{22}$ alkyl or aryl, $R_2$ is a $C_1$ to $C_{22}$ alkyl or aryl, $R_4$ is hereinbefore defined and $D_1$ is O, S or N—$R_6$ wherein $R_6$ is a $C_1$–$C_{10}$ alkyl, or alkylaryl and when D is an amino group, then $R_4$, $R_6$ and $D_1$ can be a part of a heterocyclic ring and a and b are whole numbers between 1 and 200.

8. The surfactant composition of claim 1 wherein the compound has the structure:

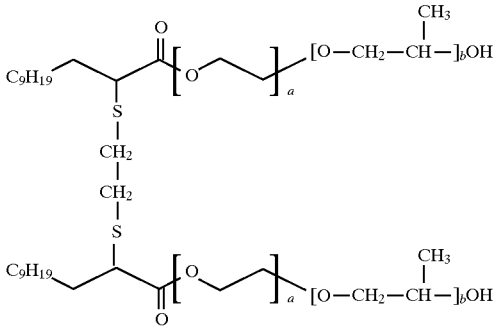

wherein a is a whole number of from about 4 to 25 and b is a whole number of from about 4 to 15.

9. The surfactant composition of claim 1 wherein the compound has the structure:

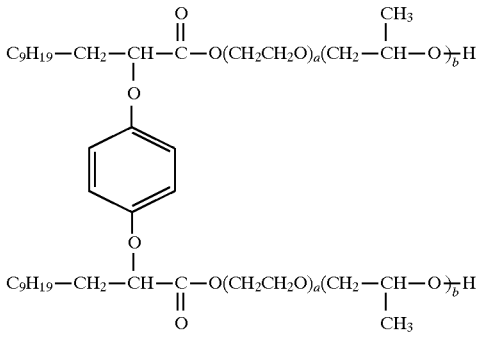

wherein a is a whole number of from about 1 to 22 and b is a whole number of from about 4 to 15.

10. The surfactant composition of claim 1 wherein the compound has the structure:

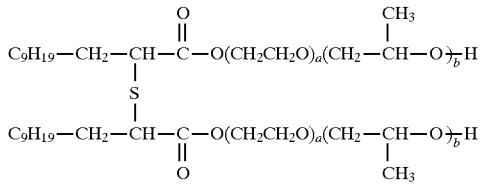

wherein a is a whole number of from about 1 to 22 and b is a whole number from about 4 to 15.

11. The surfactant composition of claim 1 wherein the compound has the structure:

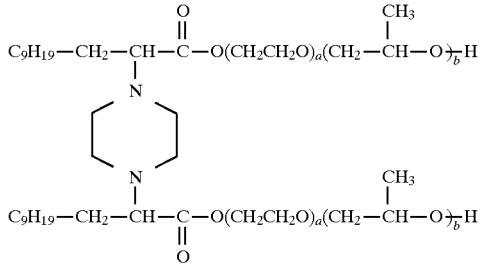

wherein a is a whole number of from about 1 to 22 and b is a whole number of from about 4 to 15.

12. A composition wherein the compound has structure:

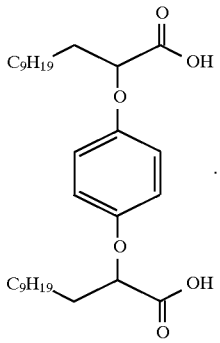

13. A surfactant blend comprising the compound of claim 1 and one or more additional compounds selected from the group consisting of anionic surfactants, nonionic surfactants, cationic surfactants, amphoteric surfactants, and mixtures thereof.

14. A surfactant blend comprising the compound of claim 2 and one or more additional compounds selected from the group consisting of anionic surfactants, nonionic surfactants, cationic surfactants, amphoteric surfactants, and mixtures thereof.

15. A surfactant blend comprising the compound of claim 3 and one or more additional compounds selected from the group consisting of anionic surfactants, nonionic surfactants, cationic surfactants, amphoteric surfactants, and mixtures thereof.

16. A surfactant blend comprising the compound of claim 4 and one or more additional compounds selected from the group consisting of anionic surfactants, nonionic surfactants, cationic surfactants, amphoteric surfactants, and mixtures thereof.

17. A surfactant blend comprising the compound of claim 5 and one or more additional compounds selected from the group consisting of anionic surfactants, nonionic surfactants, cationic surfactants, amphoteric surfactants, and mixtures thereof.

18. A surfactant blend comprising the compound of claim 6 and one or more additional compounds selected from the group consisting of anionic surfactants, nonionic surfactants, cationic surfactants, amphoteric surfactants, and mixtures thereof.

19. A surfactant blend comprising the compound of claim 7 and one or more additional compounds selected from the group consisting of anionic surfactants, nonionic surfactants, cationic surfactants, amphoteric surfactants, and mixtures thereof.

20. A surfactant blend comprising the compound of claim 8 and one or more additional compounds selected from the group consisting of anionic surfactants, nonionic surfactants, cationic surfactants, amphoteric surfactants, and mixtures thereof.

21. A surfactant blend comprising the compound of claim 9 and one or more additional compounds selected from the group consisting of anionic surfactants, nonionic surfactants, cationic surfactants, amphoteric surfactants, and mixtures thereof.

22. A surfactant blend comprising the compound of claim 10 and one or more additional compounds selected from the group consisting of anionic surfactants, nonionic surfactants, cationic surfactants, amphoteric surfactants, and mixtures thereof.

23. A surfactant blend comprising the compound of claim 11 and one or more additional compounds selected from the group consisting of anionic surfactants, nonionic surfactants, cationic surfactants, amphoteric surfactants, and mixtures thereof.

24. A surfactant blend comprising the compound of claim 12 and one or more additional compounds selected from the group consisting of anionic surfactants, nonionic surfactants, cationic surfactants, amphoteric surfactants, and mixtures thereof.

25. A cleaning composition comprising the compounds of claim 3.

26. A cleaning composition comprising the compounds of claim 4.

27. A cleaning composition comprising the compounds of claim 5.

28. A cleaning composition comprising the compounds of claim 6.

29. A cleaning composition comprising the compounds of claim 7.

30. A cleaning composition comprising the compounds of claim 8.

31. A cleaning composition comprising the compounds of claim 9.

32. A cleaning composition comprising the compounds of claim 10.

33. A cleaning composition comprising the compounds of claim 11.

34. A cleaning composition comprising the compounds of claim 12.

35. A cleaning composition comprising the blend of claim 13.

36. A cleaning composition comprising the blend of claim 19.

* * * * *